United States Patent [19]

Holschbach

[11] Patent Number: 4,829,887

[45] Date of Patent: May 16, 1989

[54] FUME HOOD WITH MULTIFUNCTIONAL SASH LOCK

[75] Inventor: Stephen E. Holschbach, Manitowoc, Wis.

[73] Assignee: Hamilton Industries, Inc., Two Rivers, Wis.

[21] Appl. No.: 248,642

[22] Filed: Sep. 26, 1988

[51] Int. Cl.[4] ..... F23J 11/00

[52] U.S. Cl. ..... 98/115.3; 49/449; 292/216; 292/DIG. 21; 292/DIG. 65; 312/215

[58] Field of Search ..... 98/115.1, 115.3; 49/68, 49/449; 292/213, 216, DIG. 21, DIG. 65; 312/215, 217, 218, 221; 220/346, 347; 137/636

[56] References Cited

U.S. PATENT DOCUMENTS 4,385,551 5/1983 Zboralski ..... 98/115.3

*Primary Examiner*—Harold Joyce

*Attorney, Agent, or Firm*—Tilton, Fallon, Lungmus

[57] ABSTRACT

A laboratory fume hood with at least two vertically-movable sashes and with a control in the form of a multifunctional sash lock that may be selectively positioned to allow only one sash to be opened at a time, or to permit both sashes to be opened but only partially, or to allow both sashes to be opened fully.

15 Claims, 2 Drawing Sheets

FIG. 2
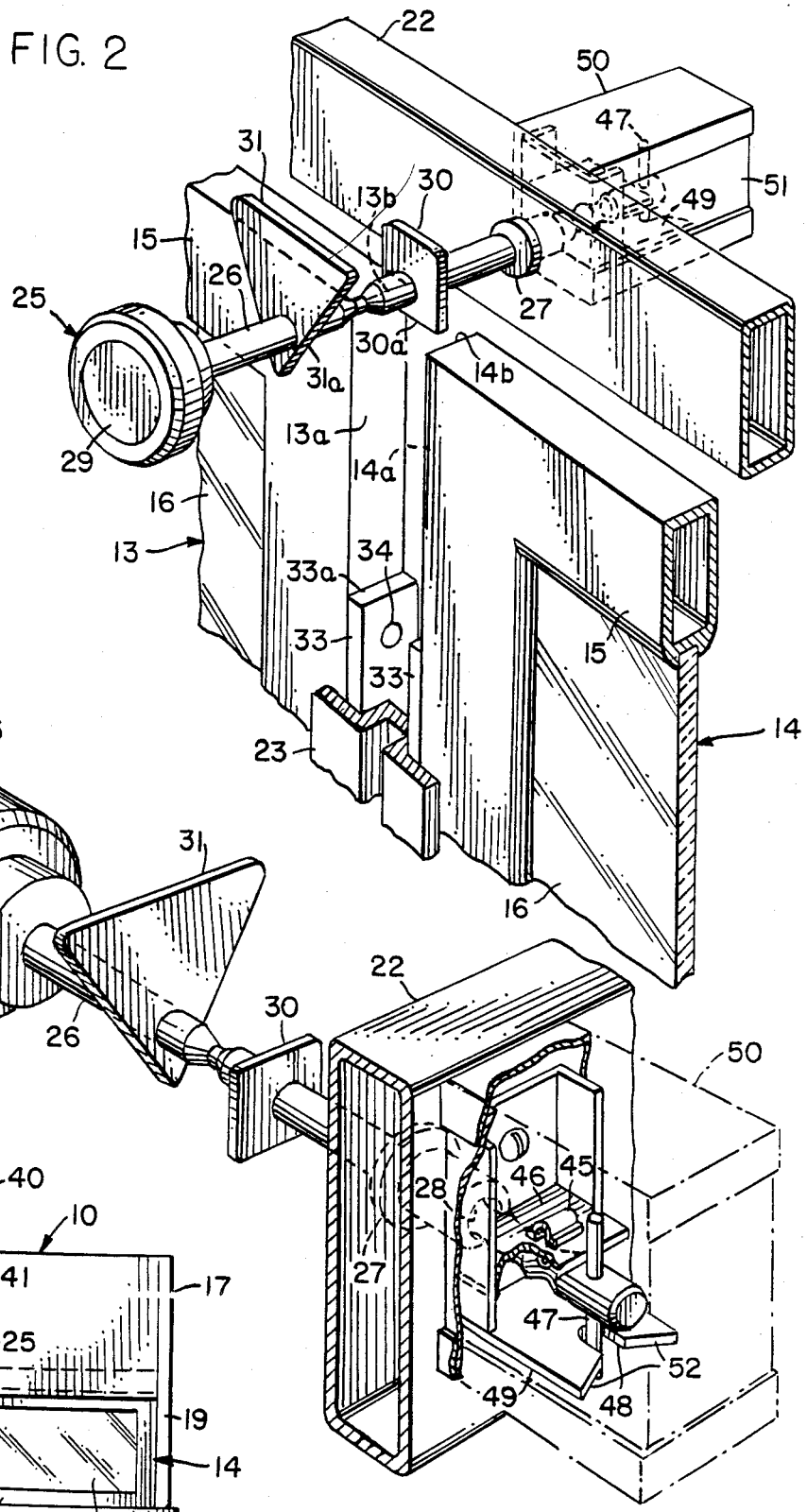
FIG. 3
FIG. 1
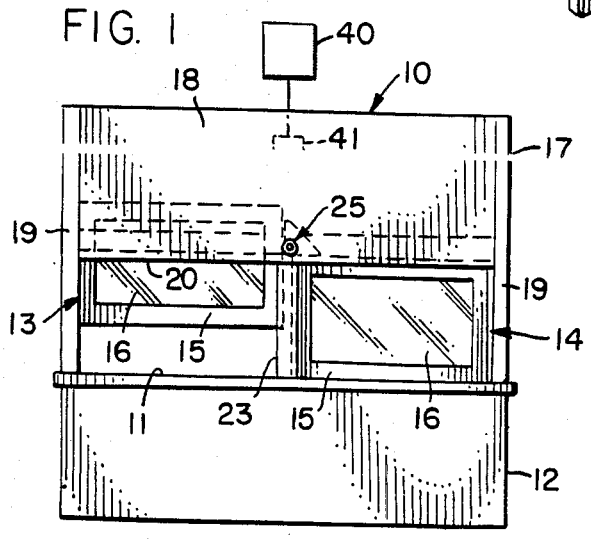

FUME HOOD WITH MULTIFUNCTIONAL SASH LOCK

BACKGROUND AND SUMMARY

U.S. Pat. No. 4,385,551 discloses a laboratory fume hood with a pair of vertically movable sashes and with a locking device that operatively couples the sashes so that one sash must be closed before the other sash may be opened. Such an arrangement allows the use of a relatively large workbench for laboratory experiments and a hood with an ample opening for access to the workbench for setting up and conducting laboratory experiments. Since both sashes cannot be raised at the same time, however, the arrangement prevents excessive amounts of heated or cooled room air from being drawn into the hood while a laboratory experiment is in progress. Perhaps more significantly, the fact that only one sash may be opened at any given time insures that noxious gases will not escape into the room when access to the work area is desired because the more limited area of the opening (in comparison with the total area of the access opening if both sashes could be fully lifted) results in greater air flow velocity through the hood opening.

Other fume hoods have been commercially available with pairs of vertically-movable sashes but, unlike the patented construction, permit both sashes to be partially raised simultaneously. Such an arrangement is advantageous because it permits the entire work area to be exposed at one time. Protection against the system becoming overloaded and resulting in possible backflow into the room is prevented by the latching means that prevents both sashes from being opened more than a limited distance (e.g., no more than halfway) when the hood is in operation.

In some instances the nature of the particular laboratory experiments or the apparatus involved may make it preferable to be able to partially open both sashes at the same time, whereas in other instances it may be more desirable to have the benefits of the patented construction that permit either one of the sashes to be opened fully while the other is locked closed. Regrettably, no prior constructions are known that give the user such a choice.

An important aspect of this invention therefore lies in providing a laboratory fume hood having two operating modes that either permit both of the vertically-movable sashes to be raised into partially-opened positions, or allow one or the other of the sashes to be lifted into a fully-opened position with the other sash automatically locked closed, whichever mode the user selects. The locking mechanism is totally mechanical (in contrast to one depending on electronic components for its bifunctional locking actions) and is highly effective and reliable as well as being relatively uncomplicated and inexpensive in construction. In a preferred form, the locking mechanism is selectively adjustable into a third operating mode that permits both sashes to be fully raised simultaneously when, for example, the hood is to be cleaned or experimental apparatus is to be erected or disassembled, during which time the fume-exhausting operation of the hood is not required. If desired, an alarm system, either audible, or visible, or both, may be incorporated so that the user will be warned against unintentionally overloading the air exhaust system by fully opening both sashes while an experiment is in progress.

Briefly, the multifunctional locking mechanism includes a horizontal shaft that is both slidably and pivotally supported by the fume hood cabinet above the access opening of that cabinet, the shaft having its axis extending along a vertical plane between and perpendicular to the sashes. The longitudinal axis of the shaft is also normal to the common vertical plane of the sashes. The shaft, which may be equipped with a knob to facilitate manual operation, is axially slidable between at least two positions of adjustment. A stop plate constituting first-stop means is mounted on the shaft and is engagable with each of the sashes when they are partially opened, but only when the shaft is in its first position of adjustment, for preventing each of the sashes from being fully opened. A second plate constituting second stop means is also mounted upon the shaft and provides a pair of abutment surfaces facing in different directions and selectively engageable with the sashes when the shaft is in a second position of adjustment. The second stop plate and the shaft on which it is mounted are automatically pivoted one way or the other when either sash is fully raised, the second stop plate when so pivoted serving to block the other sash from being even partially raised. Thus, by sliding the shaft of the multifunctional locking mechanism into either its first or second positions of adjustment, a user may lift both sashes partially or, alternatively, lift only one of the sashes fully.

In the preferred embodiment of the invention, the shaft may also be shifted axially into a third position of adjustment in which neither of the stop plates is engagable with the sashes. Under such circumstances, both of the sashes may be fully raised to expose the work area to its fullest extent, for cleaning, for the setup or disassembly of equipment, or for any other purpose. Optionally, signalling means emitting either a visible or audible signal, or both, may be provided to warn the user that both sashes have been fully opened and that operation of the hood under such conditions could be dangerous.

Other features, objects and advantages of the invention will become apparent from the specification and drawings.

DRAWINGS

FIG. 1 is a front elevational view of a fume hood embodying the invention and showing one sash in partially-raised position.

FIG. 2 is an enlarged fragmentary perspective view showing a pair of sashes and the multifunctional lock mechanism.

FIG. 3 is a still further enlarged perspective view illustrating details of the multifunctional lock mechanism.

DETAILED DESCRIPTION OF PREFERRED EMBODIMENT

Figures 4, 4A, 4B, 5, 5A, 5B, 6, 6A, 6B:
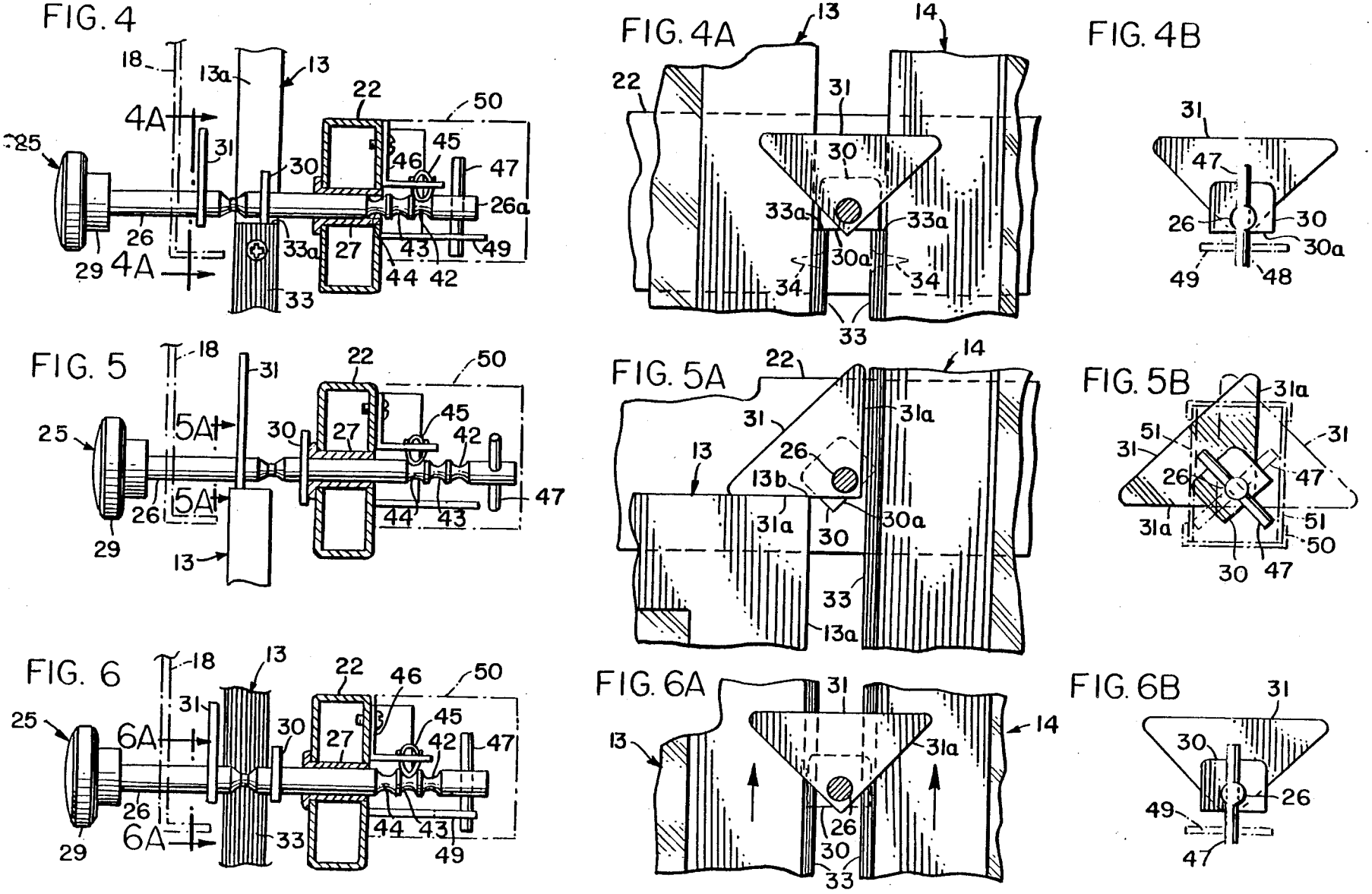
FIG. 4 is a vertical sectional view shown partly in phantom and illustrating the lock mechanism in its first position of adjustment, the mechanism being depicted in relation to one of the sashes.
FIG. 4A is a sectional view taken along line 4A—4A of FIG. 4 showing the relationship between the lock mechanism and the sashes when the mechanism is in its first position of adjustment.
FIG. 4B is a schematic end view depicting the position of the shaft and its stop plates and pivot restraining means when the mechanism is in its first position of adjustment.
FIG. 5 is a sectional view similar to FIG. 4 but depicting the lock mechanism in its second position of adjustment.
FIG. 5A is a sectional view taken along line 5A—5A of FIG. 5.
FIG. 5B is a schematic view illustrating the angular position of the shaft and stop plates when the mechanism is in its second position of adjustment and also illustrating the means for limiting the extent of pivotal movement of the shaft and stop plates.
FIG. 6 is a sectional view similar to FIGS. 4 and 5 but showing the lock mechanism in its third position of adjustment.
FIG. 6A is a sectional view taken along line 6A-6A of FIG. 6.
FIG. 6B is a schematic view depicting the shaft and stop plates when the mechanism is in its third position of adjustment.

Referring to FIG. 1, the numeral 10 generally designates a fume hood extending over the surface 11 of a workbench 12 and having a pair of vertically-movable counterbalanced sashes 13 and 14. Each sash includes an outer frame member 15 and a transparent central panel 16 formed of glass or other suitable material.

The fume hood includes a conventional cabinet 17 having front, rear, side, and top walls, of which only the front wall 18 and side walls 19 are shown in FIG. 1. The walls in combination with the top surface 11 of bench 12 define an enclosure having an access opening 20 between the lower edge of front wall 18 and work surface 11. A horizontal frame member 22 spans the front of the hood above opening 20 and, if desired, a vertical guide post or member 23 may be disposed between the sashes. The vertical post 23 may be omitted if it is desired to have the access opening 20 free of central obstruction when both sashes are raised; however, in that event, resilient sealing strips formed of suitable elastomeric material should extend along the vertical opposing edges of the respective sashes to close any spacing that might otherwise exist between the sashes when they are lowered.

The multifunctional locking mechanism is designated generally by the numeral 25 and includes a horizontal shaft 26 that is slidably and rotatably supported by frame member 22. As shown most clearly in FIGS. 2 and 3, a bushing 27 extends horizontally through the frame member 22 and has an axial opening 28 which slidably and rotatably receives the control shaft 26. The outer end of the shaft is provided with handle means in the form of knob 29 and a pair of spaced stop plates 30 and 31 are mounted on the shaft between frame member 22 and knob 29.

As shown most clearly in FIG. 2, the two sashes extend along the same vertical plane and have opposing side edges 13*a* and 14*a* that are spaced apart. Narrow, planar, vertical strips 33 are secured by screws 34 or by any other suitable means to the opposing edge surfaces 13*a* and 14*a*, the two strips being disposed in parallel and having their opposing surfaces spaced apart. It will be noted in particular that the strips are both of a length substantially less than the height of the sashes on which they are mounted and, specifically, that the strips have their upper ends 33*a* terminating well below the upper limits of the sashes.

The horizontal control shaft 26 is centrally positioned with its axes normal to the common plane of the sashes. When the sashes are closed, as depicted in FIG. 2, the shaft is disposed above (and between) both of the sashes. The spacing between the sashes, and particularly between vertical strips 33, is substantially greater than the diameter of shaft 26 so that, as depicted in FIG. 6A, both sashes may be lifted without contacting the shaft located midway between them.

The first stop plate 30 is generally rectangular in configuration with a straight and normally horizontal bottom edge 30*a* and a width that is slightly less than the distance between parallel surfaces 13*a* and 14*a* of the sashes but greater than the distance between the opposing surfaces of vertical strips 33. Therefore, when the axially-slidable shaft 26 is in a first position of adjustment depicted in FIGS. 4, 4A, and 4B, with stop plate 30 in alignment with the sashes, the sashes 13 and 14 can be partially raised only to the point at which the upper end surfaces 33*a* of strips 33 engage the underside or bottom edge 30*a* of the stop plate. FIG. 4A therefore depicts the two sashes locked by the first stop plate 30 in their partially-opened or raised positions. Further upward movement of the sashes is blocked as long as the lock mechanism is in its first axial position of adjustment.

It is to be understood that the length of strips 33 may be varied and, specifically, that the upper ends of the strips may terminate at any selected distance below the upper limits of the sashes, to achieve what is considered to be a safe and effective maximum partially-opened condition for each of the sashes when the lock mechanism is in its first position of adjustment.

The second stop plate 31 is generally triangular in shape and has a pair of abutment surfaces 31*a* that normally face downwardly and outwardly and are disposed at generally right angles to each other. Each surface 31*a* has a length substantially greater than the distance between the edge surfaces 13*a* and 14*a* of sashes 13 and 14, respectively. Shaft 26 extends through the second plate at a point in close proximity to the intersection of surfaces 31*a*. In particular, the distance between each surface 31*a* and the outer surface of the shaft is less than the distance between the shaft's outer surface and the surfaces of the bearing strips 33 affixed to the sashes (FIG. 5A).

When the lock mechanism is in its second position of adjustment depicted in FIGS. 5, 5A, and 5B, the second stop plate 31 is disposed in vertical alignment with sashes 13 and 14. Abutment surfaces 31*a* normally face downwardly and outwardly at 45 degrees from the vertical (FIG. 4A) and are disposed in close proximity to the upper inner corners 13*b* and 14*b* of the respective sashes. When either one of the sashes is raised as, for example, when sash 14 is raised, its upper corner 14*b* and surface 14*a* engage one of the abutment surfaces 31*a* of the second stop plate to cause that plate and the shaft 26 to which it is affixed to pivot 45 degrees in a counterclockwise direction when viewed from the front of the fume hood to cause the other abutment surface 31*a* to engage the top of the other sash 13 to block it from being raised (FIGS. 5 and 5A). Conversely, should sash 13 be raised while sash 14 is lowered, the stop plate 31 and shaft 26 would pivot in a clockwise direction into the position depicted in broken lines in FIG. 5B to block raising of the other sash 14. As a result, when the locking mechanism is in its second position of adjustment, either sash may be raised (and may be fully raised because the first stop plate 30 is displaced from the path of movement of the sash, as shown in FIG. 5) but the other sash cannot be opened to any appreciable extent.

In the preferred embodiment depicted in the drawings, the spacing between stop plates 30 and 31 is greater than the thickness of the sashes. By shifting the lock mechanism into a third or intermediate position of adjustment in which both of the stop plates 30 and 31 are out of vertical alignment with the sashes, both sashes may be raised to their fullest extent. Such a condition is depicted in FIGS. 6, 6A, and 6B. Since the raising of both sashes to their fullest extent at the same time could be dangerous if such a condition were to prevail while noxious fumes are being generated within the hood, a warning device 40 having a contact means 41 may be mounted on the hood, as diagrammatically shown in FIG. 1. Contact means 41 may take the form of limit switches which, when engaged by both of the fully-raised sashes, trigger an electrically-powered alarm which may be audible, visible, or both. Since electrical warning devices in the form of bells, sirens, and lights are all well known in the art, and because any of a variety of such devices might be utilized here, detailed discussion of the construction and operation of such a warning device is believed unnecessary.

FIGS. 4, 5, and 6 clearly reveal control shaft 26 has an axial series of indentations or recessed portions 42–44. Spring detent means 45 carried by a bracket 46 secured to frame member 22 yieldably engages the shaft in its reduced areas to exert a limited holding force when the shaft is in any of its three positions of adjustment. In the embodiment illustrated, the spring detent means takes the form of an oval spring element; however, other forms of detents, such as a leaf spring or a contact element urged radially by a coil spring, may be used. When the lock mechanism is in its first position of adjustment, spring 45 is received in recess 42 of the shaft (FIG. 4), when it is in its second position of adjustment, the spring is seated in recess 44, and when in its third or intermediate position of adjustment, the spring is seated in intermediate recess 43. It will be observed that since the recesses are annular, rotation of the shaft 26 and knob 29 will not release the spring force holding the locking mechanism in its selected position of adjustment. A change from one position to another is achieved only by applying sufficient axial force to knob 29 to overcome the restraining force of spring 45.

It is important that knob 29 and shaft 26 be restrained against rotation, and that stop plate 30 be position with its undersurface **30*a* extending horizontally, when the lock mechanism is in its first position of adjustment (FIGS. 4, 4A). Such control is achieved by securing a transverse pin 47 to the inner end portion 26*a* of the control shaft 26 as shown most clearly in FIGS. 4 and 4B. When the lock mechanism is in its first position of adjustment, one of the protruding ends of pin 47 is received in the open ended slot 48 of a pivot-controlling plate 49 that extends in a direction parallel with the axis of shaft 26 (FIGS. 3, 4, and 4B). The slotted plate 49 and pin 47 therefore lock the shaft against rotation and in a position in which stop plate 30 has its undersurface 30*a* facing downwardly for engagement with the upper ends 33*a* of strips 33 (FIG. 4A). However, when the shaft is shifted axially to place the lock mechanism 25 in its second position of adjustment, pin 47 is displaced from the slot and the shaft 26 is free to rotate or pivot to a limited extent (FIGS. 5, 5A). More specifically, as depicted in FIG. 5B, the shaft 26 may be pivoted one way or the other until pin 47 assumes a position approximately 45 degrees in either direction from the vertical (FIG. 5B). Means for limiting the extent of such pivotal movement may take various forms, but it has been found particularly effective to provide such means in the form of an enclosure or housing 50 with side walls 51 that engage the ends of the transverse pin and thereby limit the extent of pivotal movement of shaft 26 and triangular stop plate 31**.

It will be observed from FIG. 3 that the pivot-controlling plate 49 is provided with a pair of angular camming surfaces 52 converging towards slot 48. When the lock mechanism is shifted from its second position of adjustment (FIGS. 5, 5A, 5B) to its third or intermediate position of adjustment (FIGS. 6, 6A, 6B), pin 47 is engagable with such camming surfaces and is directed into vertical position towards slot 48.

While in the foregoing I have disclosed an embodiment of the invention in considerable detail for purposes of illustration, it will be understood by those skilled in the art that many of these details may be varied without departing from the spirit and scope of the invention.

I claim:

1. A fume hood comprising a cabinet having an access opening and a pair of adjacent vertically-movable sashes extending along substantially the same vertical plane for closing and opening portions of said access opening; said cabinet including a frame member extending above said access opening; said sashes having a pair of vertical side edge portions spaced laterally apart; and a multifunctional sash lock mounted upon said frame member; said sash lock including a horizontal shaft slidably and pivotally supported by said frame member and extending between said sashes with its longitudinal axis normal to said plane of said sashes; said shaft being axially slidable between at least two selected axial positions of adjustment; first stop means mounted on said shaft and engagable with each of said sashes when said sashes are partially opened, and only when said shaft is in a first axial position of adjustment, for preventing each of said sashes from being fully opened; and second stop means mounted upon said shaft and providing a pair of abutment surfaces facing in different directions and engagable with said sashes when said shaft is in a second axial position of adjustment; said second stop means being pivotal between a first angular position wherein one of said abutment surfaces is shifted upwardly by the raising of one of said sashes and the other of said abutment surfaces blocks the raising of other of said sashes, and a second angular position wherein the other of said abutment surfaces is shifted upwardly by the raising of the other of said sashes and said one abutment surface blocks the raising of said one sash, thereby allowing only one sash to be raised at a time when said shaft is in said second axial position of adjustment.

2. The fume hood of claim 1 in which said shaft is movable into a third axial position of adjustment wherein said first and second stop means are positioned out of engagement with both of said sashes, thereby allowing both of said sashes to be fully raised at the same time.

3. The fume hood of claims 1 or 2 in which said first stop means comprises a first stop plate secured to said shaft and extending along a plane normal to the longitudinal axis thereof; said first stop plate having a lower edge engagable with each of said sashes to block said sashes from being shifted upwardly beyond partially raised positions.

4. The fume hood of claim 3 in which said first stop plate is generally rectangular in shape; said lower edge extending horizontally when said shaft is in its first position of adjustment.

5. The fume hood of claim 4 in which said first stop plate includes a pair of side edges that extend vertically when said shaft is in said first position of adjustment; said side edges of said first stop plate being spaced farther apart than said pair of vertical side edge portions of said sashes to engage said side edge portions and prevent raising of both of said sashes into fully opened positions when said shaft is in said first position of adjustment.

6. The fume hood of claim 5 in which said side edge portions of said sashes are defined by a pair of vertical strips secured to opposing edge surfaces of said sashes; said strips having upper ends terminating predetermined distances below the upper limits of said sashes.

7. The fume hood of claim 3 in which said second stop means comprises a second stop plate secured to said shaft and extending along a plane normal to the longitudinal axis thereof; said second stop plate being spaced from said first stop plate along said axis of said shaft.

8. The fume hood of claim 7 in which said abutment surfaces of said second stop plate are planar and are disposed at substantially right angles to each other.

9. The fume hood of claim 2 in which each of said sashes has a pair of oppositely-facing vertical surfaces; said first and second stop means being spaced apart on said shaft a distance greater than the distance between said vertical surfaces of said sashes; said sashes being free to pass upwardly between said first and second stop means when said shaft is in its third axial position of adjustment.

10. The fume hood of claims 1 or 2 in which shaft has an end portion projecting outwardly beyond said sashes; said outwardly projecting end portion being provided with a control handle.

11. The fume hood of claims 1 or 2 in which contact means are provided for engaging both of said sashes when the same are fully raised; said contact means being operatively associated with an electrical warning device for providing a warning signal when both of said sashes are fully raised.

12. The fume hood of claims 1 or 2 in which said shaft has an axial series of annular recesses; and spring detent means receivable in each of said recesses for frictionally restraining said shaft in each of said selected axial positions of adjustment.

13. The fume hood of claims 1 or 2 in which pivot control means are provided by said cabinet and said shaft for preventing pivotal movement of said shaft in said first axial position of adjustment.

14. The fume hood of claim 13 in which said pivot control means comprises a transversely-extending pin secured to said shaft; said pin having at least one end portion projecting radially from said shaft; and a plate fixed to said frame member of said cabinet; said plate having a slot for receiving said end portion of said transverse pin when said shaft is in said first position of adjustment.

15. The fume hood of claim 14 in which said cabinet is provided with means for limiting the range of pivotal movement of said shaft when said shaft is in said second axial position of adjustment; said means comprising a pair of walls secured to said frame member and engagable with said end portion of said pin when said shaft is in its second position of adjustment.

* * * * *